US005871376A

United States Patent [19]

Tsai et al.

[11] Patent Number: 5,871,376

[45] Date of Patent: Feb. 16, 1999

[54] ELECTRICAL CONNECTOR FOR COMPUTERS

[76] Inventors: Yen Hui Tsai, No 12, Sec 15, Chi hsiang St, Hsin Tien City, Taipei Hsien, Taiwan; I-Ching Hsu, No. 6, Nan-kung Rd, Chung Ho City, Taipei Hsien, Taiwan

[21] Appl. No.: 668,813

[22] Filed: Jun. 24, 1996

[51] Int. Cl.[6] ..... H01R 33/92

[52] U.S. Cl. ..... 439/651; 439/499

[58] Field of Search ..... 439/651–653, 439/696, 701, 499, 687

[56] References Cited

U.S. PATENT DOCUMENTS

| | | | |
|---|---|---|---|
| 3,745,515 | 7/1973 | Michaels | 439/651 |
| 3,813,634 | 5/1974 | Wigby et al. | 439/499 |
| 4,008,941 | 2/1977 | Smith | 439/499 |
| 4,386,820 | 6/1983 | Dola et al. | 439/651 |
| 5,057,650 | 10/1991 | Urushibata et al. | 439/499 |
| 5,064,389 | 11/1991 | Klein et al. | 439/651 |
| 5,078,620 | 1/1992 | Verhoeven | 439/687 |
| 5,228,874 | 7/1993 | Lin | 439/687 |
| 5,346,412 | 9/1994 | Fedder et al. | 439/701 |

*Primary Examiner*—Gary F. Paumen
*Assistant Examiner*—Brian J. Biggi
*Attorney, Agent, or Firm*—Bacon & Thomas

[57] ABSTRACT

An improved electrical connector for computers adapted for connecting electric currents to cooling fans of CPUs or computer peripheral equipment. The electrical connector includes a front housing and a rear housing joined together integrally and a plurality of contacts each comprised of a front portion and a rear portion fitted respectively to the ends of a connection portion, the contact being placed inside the front and rear housings. The contacts are firmly held within the housing due to the configuration of the inner walls of the front and rear housings. The assembly process is simplified and costs reduced. The overall reduced size of the electrical connector occupies makes efficient use of the limited space of the computer.

3 Claims, 3 Drawing Sheets

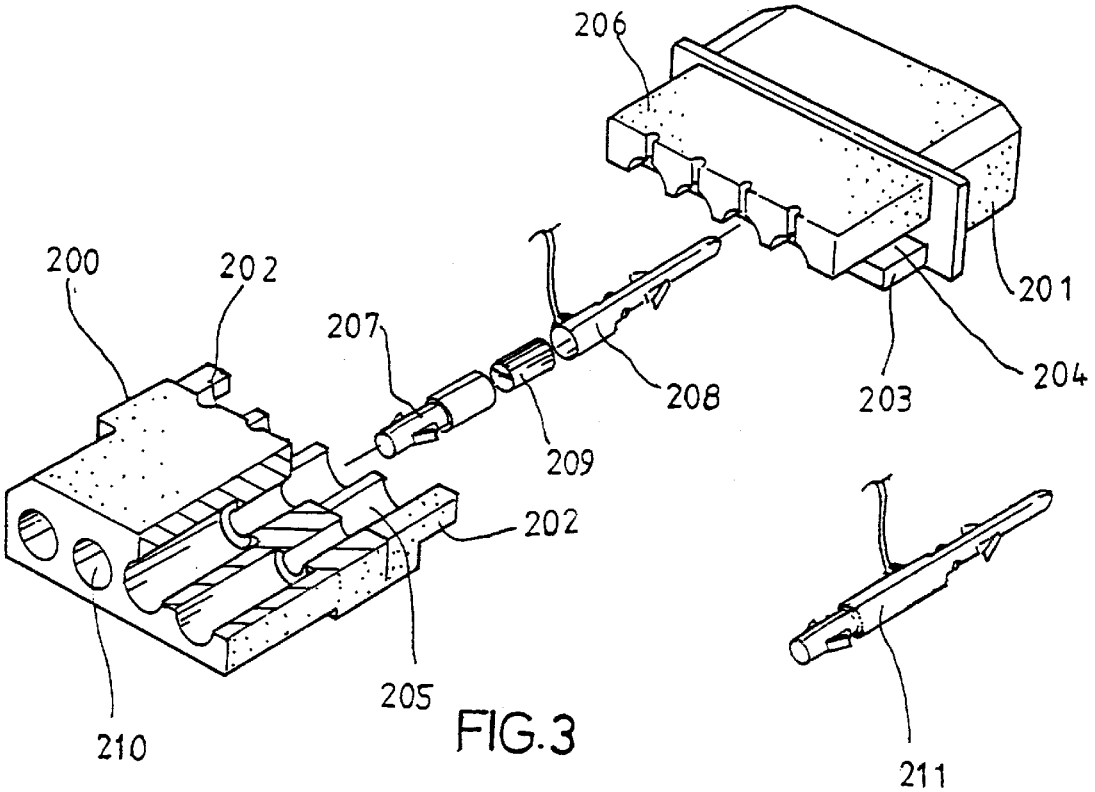
FIG.3
FIG.3A
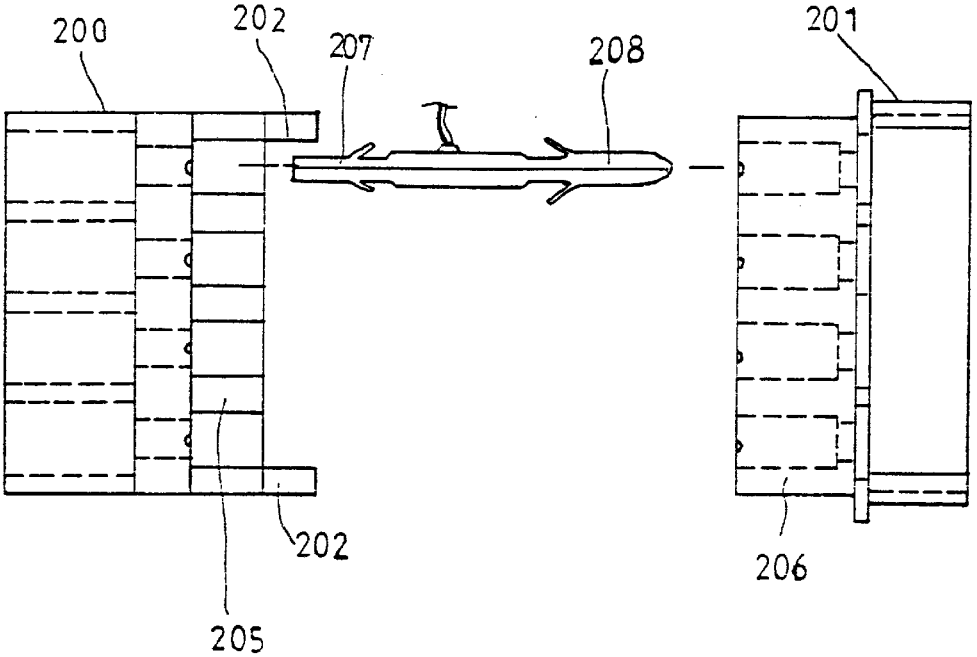
FIG.4

ELECTRICAL CONNECTOR FOR COMPUTERS

BACKGROUND OF THE INVENTION

1. Field of the Invention

The present invention relates generally to an improved electrical connector for computers, and more particularly to an improved electrical connector which has a reduced size, simplifies the assembly process and lower costs, and which is able to provide a good support for contacts accommodated in the computer housing so that they may not easily become loosened and drop out.

2. Description of the Prior Art

Personal computers have developed very fast in the past years and they are equipped with more new functions. To be used in conjunction with multi-media equipment, the computer must firstly be installed with peripheral equipment such as CD-ROMs. With the significant improvement in the operational speed of computers, cooling fans become indispensable for dissipating the high heat generated by the CPU chips during high-speed operation of the computer. Addition of peripheral equipment like CD-ROMs or installation of cooling fans in the computer requires the installation of an electrical connector such as the one shown in FIG. 1 for conducting electric currents from a power supplier to the peripheral equipment or cooling fans.

The conventional electrical connector shown in FIG. 1 essentially comprises a first connector 100 and a second connector 101, which are connected by a plurality of electrical wires 102. Such an electrical connector requires a relative large number of components; it also complicates the assembly process and requires more labor and material, hence increasing the costs. Besides, because the connectors 100 and 101 as well as the electrical wires 102 occupy considerable space, the arrangement of the electrical wires within the computer will be complicated when they are disposed in the interior of the computer where there is limited space. Furthermore, the contacts disposed in the first connector 100 and the second connector 101 have only a portion thereof supported, they may easily become loosened. As a result, the contacts cannot precisely fit into the corresponding receptacles.

SUMMARY OF THE INVENTION

Accordingly, a primary object of the present invention is to provide an improved electrical connector for computers which is simple in construction so that the assembly process may be simplified, labor and costs reduced.

In order to achieve the above-mentioned object, a preferred embodiment of the improved electrical connector of the invention comprises an integrally formed housing accommodating a plurality of contact which are comprised of a front portion, a rear portion and a connecting portion, the front portion and the rear portion being fitted to the ends of the connecting portion, the contacts being firmly held within the housing due to the configuration of the inner walls of the housing.

BRIEF DESCRIPTION OF THE DRAWINGS

The foregoing and other features and advantages of the present invention will be more clearly understood from the following detailed description and the accompanying drawings, in which.

FIG. 3 is an exploded elevational view of the improved electrical connector according to the present invention;

FIG. 3A is a schematic view of an embodiment of the contact according to the present invention;

FIG. 4 is an exploded sectional view of the improved electrical connector according to the present invention;

DETAILED DESCRIPTION OF THE PREFERRED EMBODIMENT

Figure 1:
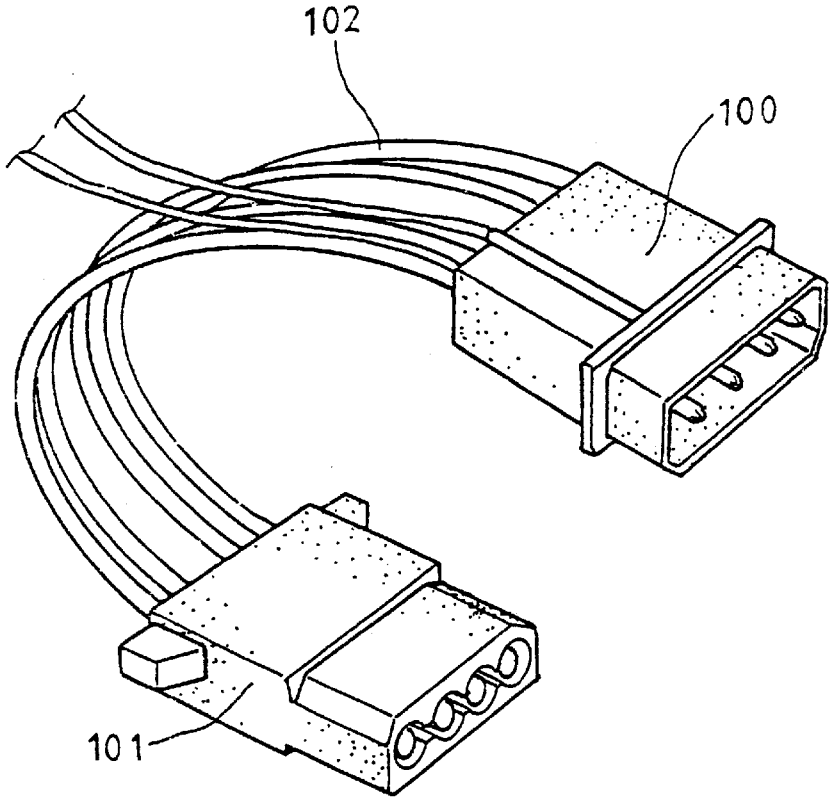
FIG. 1 (PRIOR ART)
FIG. 1 is a schematic view of a conventional electrical connector for computers.
Figure 2:
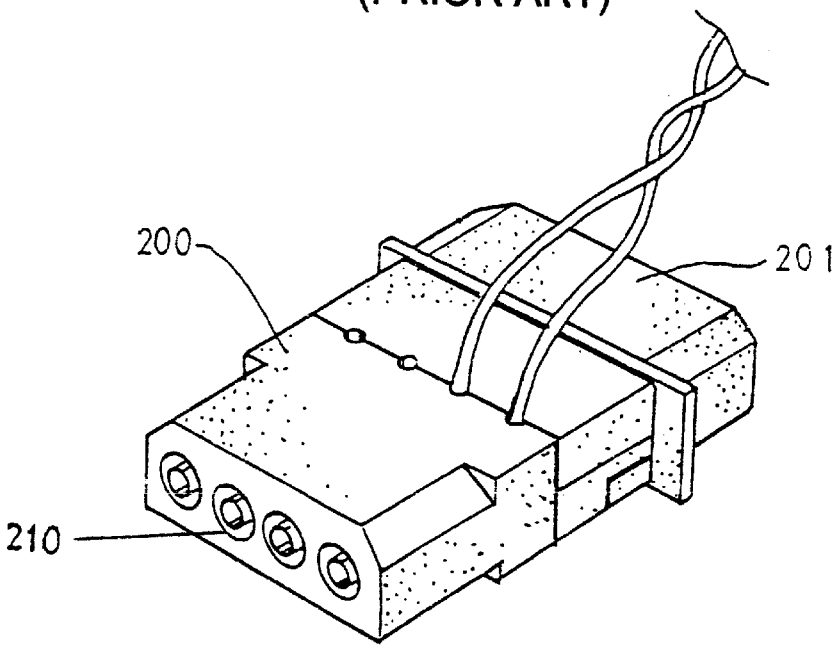
FIG. 2 is a schematic view of a preferred embodiment of the improved electrical connector according to the present invention.

FIG. 2 is a schematic view of a preferred embodiment of the improved electrical connector according to the present invention. As can be seen from the figure, the improved electrical connector of the invention essentially comprises a single housing having an upper portion and a lower portion. A plurality of plug holes 210 are arranged at both the front and the rear ends of the housing for receiving a plurality of contacts disposed in the housing. Since an electrical connector having a single housing may occupy less space, require less assembly work and reduce use of the wire material, the overall cost of manufacturing the electrical connectors of the invention may be substantially lowered.

With reference to FIG. 3, the electrical connector of the invention is comprised of a front housing 200 and a rear housing 201 butt joined together. The respective interiors of the front housing 200 and the rear housing 201 are provided with a plurality of plug holes 210 for receiving the contacts, the plug holes 210 being spaced apart from each other. The front housing 200 has a rear portion forming a plurality of upper recessed stepped portions 205 at a top side thereof. A guide post 202 extends outwardly from either side of the rear portion of the front housing 200. Correspondingly, the rear housing 201 has a front portion provided with a plurality of lower recessed stepped portions 206 at a bottom side thereof, and a plate-like portion 203 extends forwardly from the lower recessed stepped portions 206. The plate-like portion 203 is arranged to be spaced a distance apart from the front portion of the rear housing 201 to define a groove 204. When the front housing 200 and the rear housing 201 are butt joined, the guide posts 202 may extend into the groove 204 of the rear housing 201 to facilitate positioning and precise assembly. Besides, by means of this arrangement, the upper recessed stepped portions 205 of the front housing 200 and the lower recessed stepped portions 206 of the rear housing 201 may be butt joined to achieve a very smooth and nice appearance. Furthermore, the contact accommodated within the front housing 200 and the rear housing 201 includes a front portion 207, a rear portion 208 and a connecting portion 209, the front portion 207 and the rear portion 208 being fitted onto the ends of the connecting portion 209. The contact may also be configured to be an integral contact 211 shown in FIG. 3A. During assembly, the contact is placed inside the plug holes 210 defined between the upper and lower recessed stepped portions 205 and 206. The entire process is very simple. The improved electrical connection of the invention as described above reduces use of materials and hence lowers costs.

Referring to FIG. 4, it can be seen that the front portion 207 and the rear portion 208 of the contact are respectively contained in the respective plug holes 210 of the front housing 200 and the rear housing 201. Due to the configuration of the inner walls of the plug holes, the contact may be firmly supported so that it may not move or slide within the plug holes 210.

Figure 5A:
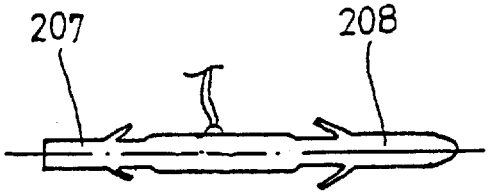
FIGS. 5A and 5B are respective schematic views of the contact showing connection of the contact with an electric wire.
Figure 5B:
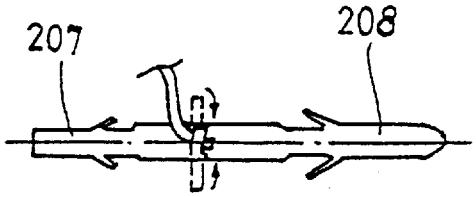

With reference to FIGS. 5A and 5B, if an electric wire is to be led out from the contact for connection with another electronic device or another power source, welding or point welding may be utilized to secure the electric wire at a middle portion of the contact as shown in FIG. 5A or, alternatively, fasten the electric wire to the contact.

Although the present invention has been illustrated and described with reference to the preferred embodiment thereof, it should be understood that it is in no way limited to the details of such embodiment but is capable of numerous modifications within the scope of the appended claims.

What is claimed is:

1. An electrical connector for a computer comprising:

a) a first housing having a plurality of spaced apart plug holes and a plurality of first recessed step portions, each recessed step portion being axially aligned with a plug hole, and at least one guide post extending therefrom;

b) a second housing joined directly to the first housing and having a plurality of second recessed step portions overlapping the plurality of first recessed step portions and a groove located to engage with the at least one guide post;

c) a plurality of contacts located within the first and second housings, each contact comprising a first portion located in one of the plurality of spaced apart plug holes for engagement with a second electrical connector, a second portion located in the second housing for engagement with a third electrical connector and a connecting portion connected to the first and second portions, the connecting portion located in one of the overlapping recessed step portions; and, d) an electrical wire connected to the connecting portion of at least one of the plurality of contacts and extending externally of the housings through an opening at a juncture of the first and second housings.

2. The electrical connector as claimed in claim 1 wherein said front portion and said rear portion of said contacts are separately joined to opposite ends of said connecting portion.

3. The electrical connector as claimed in claim 1, wherein said contacts are integrally formed.

* * * * *